US005196837A

United States Patent [19]

Shoji et al.

[11] Patent Number: 5,196,837

[45] Date of Patent: Mar. 23, 1993

[54] CURSOR GENERATING APPARATUS

[75] Inventors: Wataru Shoji; Daisuke Tabuchi; Ichiro Nakajima, all of Tokyo, Japan

[73] Assignee: Kabushiki Kaisha Dainichi, Tokyo, Japan

[21] Appl. No.: 689,339

[22] Filed: Apr. 23, 1991

[30] Foreign Application Priority Data

Apr. 24, 1990 [JP] Japan ..... 2-107765

[51] Int. Cl.[5] ..... G09G 1/06

[52] U.S. Cl. ..... 340/723; 340/709

[58] Field of Search ..... 340/706, 709, 710, 711, 340/712, 723, 707, 799, 798

[56] References Cited

U.S. PATENT DOCUMENTS 4,101,879 7/1978 Kawaji et al. .
4,354,185 10/1982 Worborschil ..... 340/709
4,668,947 5/1987 Clarke, Jr. et al. ..... 340/706
4,987,551 1/1991 Garrett, Jr. ..... 340/709

FOREIGN PATENT DOCUMENTS 0139932 5/1985 European Pat. Off. .
0146657 7/1985 European Pat. Off. .

*Primary Examiner*—Ulysses Weldon
*Assistant Examiner*—Doon Y. Chow
*Attorney, Agent, or Firm*—Beveridge, DeGrandi, Weilacher & Young

[57] ABSTRACT

A cursor generating apparatus applicable to computer graphics is disclosed. The cursor generating apparatus comprises registers (47, 49) for receiving and holding information indicative of start and end points of a vertical cursor; a counter (57) for counting block numbers now being scanned on the basis of scanning timing related signals, when a scanning line is divided into plural blocks each including a predetermined number of pixels on the display screen; comparators (53, 55) for comparing the block number outputted from this counter (57) with a block number belonging to start and end points included in the information held in the registers (47, 49) and generating start and end point timing signals; and a circuit (63) for generating a width timing signal on the basis of the start and end point timing signals. These start and end point timing signals, the width timing signal, and some information indicative of the start and end points are applied to the vertical cursor data memory (65) as address data. Since a pattern group of previously programmed cursor data of a predetermined number of bits is stored in the vertical cursor data memory (65), one pattern corresponding to address data is read out of the group. The parallel data of the read pattern are converted into serial data by a register (25), and further into video signals, before transmitted to a display unit (7).

1 Claim, 6 Drawing Sheets

CURSOR GENERATING APPARATUS

BACKGROUND OF THE INVENTION

1. Field of the Invention

The present invention relates to a cursor generating apparatus applicable to computer graphics.

2. Description of the Prior Art

In general, a computer graphics system includes an image memory in which graphics data (whose each bit corresponds to each pixel (picture element) on a display screen) are stored. These graphics data are read from the image memory in raster fashion, converted into video signals, and then applied to a display unit for display of a graphic image.

Conventionally, when a cursor is required to be displayed on an image display in overlap condition, graphics data for displaying a cursor (referred to as cursor data) are formed by a host computer, and the formed cursor data are written in the image memory in overlap condition with graphics data originally stored in the image memory. Therefore, when the cursor is required to be moved, the old cursor data are once erased in the image memory; and then new cursor data corresponding to a new cursor position are formed again; the formed cursor data are written in the image memory; and the above process is repeated.

In the above-mentioned prior-art technique, it has been difficult to move the cursor smoothly at high speed, because it takes much time to form the cursor data and store them in the image memory. Subsequently, in the case of a system in which cursor position is controlled by a mouse, for instance, there exists a problem in that when the mouse is moved at a high speed, the cursor cannot follow the movement of the mouse smoothly, so that the cursor is moved being skipped.

SUMMARY OF THE INVENTION

With these problems in mind, therefore, it is the object of the present invention to provide a cursor generating apparatus which can move cursor smoothly at high speed.

To achieve the above-mentioned object, the present invention provides a cursor generating apparatus for generating cursor data supplied in series to a display unit to display a cursor on a display screen in computer graphics, comprising: register means for receiving and holding information indicative of start and end points of a cursor on the display screen and given from a host computer; counting means for counting block numbers now being scanned on the basis of scanning timing related signals, when a scanning line is divided into plural blocks each including a predetermined number of pixels on the display screen; comparing means for comparing the block number outputted from said counting means with a specific block number belonging to start and end points included in the information held in said register means and generating start and end point timing signals corresponding to the compared result; generating means for generating a width timing signal on the basis of the start and end point timing signals; cursor data memory means for receiving start and end point pixel numbers in a specific block included in the information indicative of the start and end points and held in said register means, the start and end point timing signals, and the width timing signal as address data and for reading one pattern in parallel from a pattern group of previously programmed cursor data of a predetermined number of bits; and shift register means for converting the pattern of cursor data read in parallel from said cursor data memory means into serial data.

In the cursor generating apparatus according to the present invention, in response to information indicative of cursor start and end points from the host computer, the apparatus generates a start point timing signal, an end point timing signal and a width timing signal. These generated signals and some information indicative of the cursor start and end points are applied to the cursor data memory means as address data. A pattern group of previously programmed cursor data of a predetermined number of bits is stored in the cursor data memory means, and a single pattern corresponding to the address data is read out of the pattern group. The read pattern is converted into serial cursor data by the shift register means.

DETAILED DESCRIPTION OF THE PREFERRED EMBODIMENTS

Figure 1:
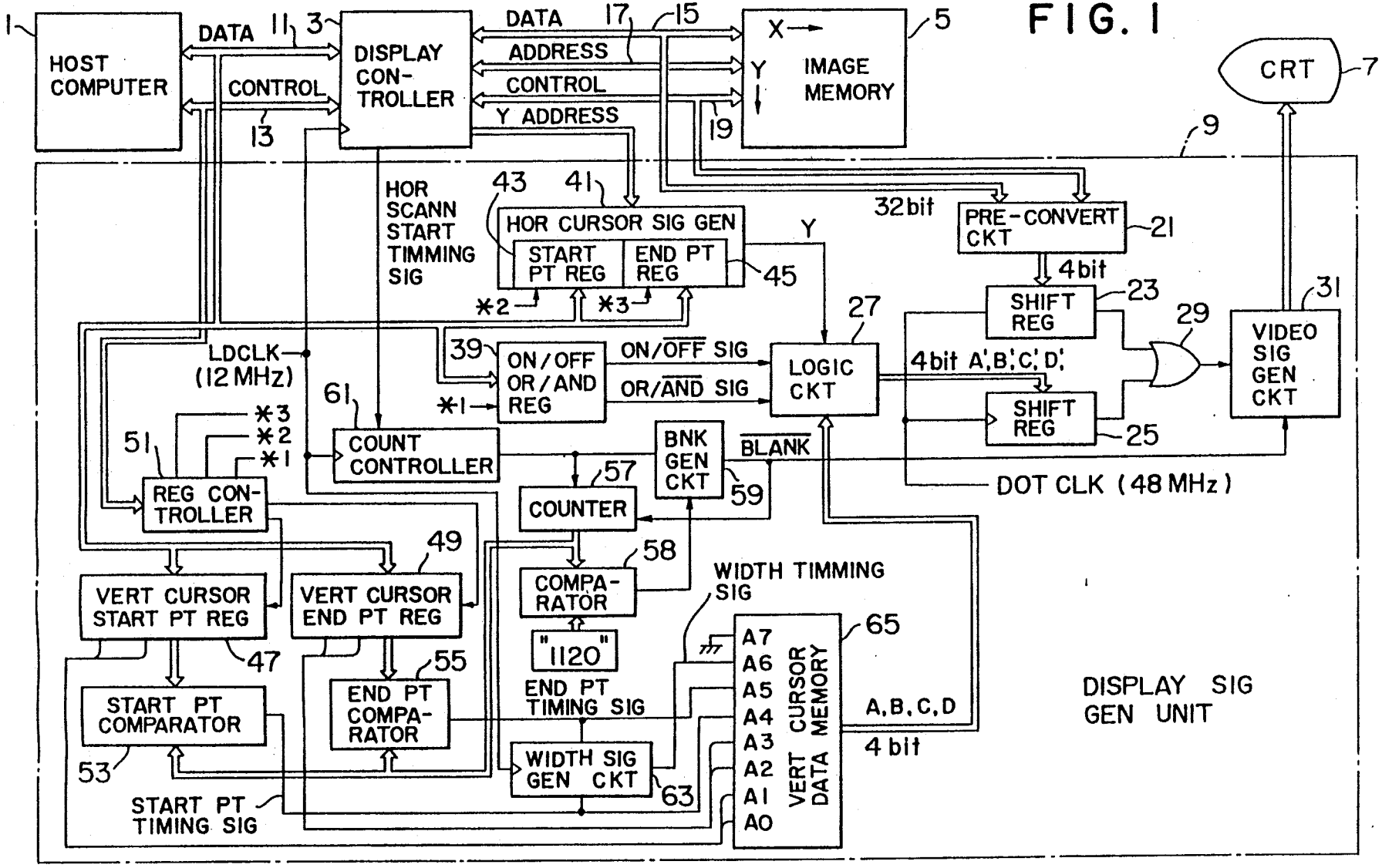
FIG. 1 is a block diagram showing an entire computer graphics system provided with the cursor generating apparatus related to an embodiment according to the present invention.

FIG. 1 shows an entire configuration of a computer graphics system provided with a preferred embodiment of the cursor generating apparatus according to the present invention.

This computer graphics system comprises a host computer 1; a display controller 3, an image memory 5, a CRT 7 and a display signal generating unit 9. The cursor generating apparatus is incorporated in the display signal generating unit 9.

Figure 2:
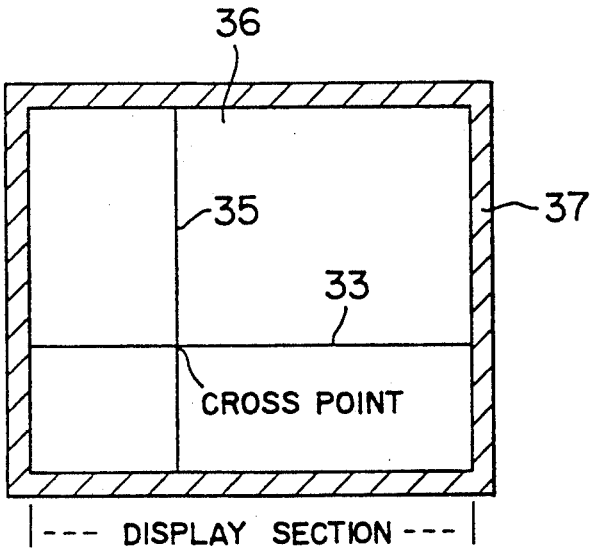
FIG. 2 is an illustration showing cursor positions moved by the apparatus shown in FIG. 1.

In this embodiment, the display screen of the CRT 7 is formed of a display area 36 on which images are displayed and a blank area 37 formed outside the display area 36, as shown in FIG. 2. The section corresponding to the horizontal scanning line in the display area 36 is referred to as a display section in this specification, and the number of pixels is 1120 dots.

The image memory 5 is a 32M-bit DRAM, for instance. In this image memory 5, an area referred to as a display area one to one corresponding to the display area 36 of the display screen is allocated at a location previously designated by the host computer 1. Each bit of graphic data stored at the display area is so determined as to correspond one to one to each pixel within the display area 36. Each bit of "1" represents a black pixel and each bit of "0" represents a white pixel. Further, a Y address in the display area represents a number of the horizontal scanning line.

The display controller 3 is mainly provided with three functions of writing graphics data in the image memory 5; reading graphics data from any given area in the image memory, and writing them in the display area, and reading graphics data from the display area and inputting them to the video signal generating unit 9.

At first, the display controller 3 receives graphic information indicative of an image from the host computer 1 via a data bus 11, and further receives control information to write graphics data in the image memory 5 via a control bus 13. Then, the display controller 3 designates a specific location in the image memory 5 via an address bus 17, and writes graphics data corresponding to graphic information and given by the host computer 1 in the image memory 5 via the data bus 15. Therefore, graphics data for all the image are stored in the image memory 5. In usual, the above-mentioned operation is executed only once at the beginning.

Therefore, the display controller 3 receives instruction information to designate a specific area from the host computer 1, in order to display a specific area in the entire image stored in the image memory 5.

Then, the display controller 3 reads graphics data in the designated specific area from the image memory 5, and writes them in the display area. The above-mentioned operation is repeated whenever an area to be displayed is required to be changed such as display area scrolling, magnification, reduction, etc.

This display controller 3 always scans addresses of the display area in the image memory 5, reads graphics data in the display area in the order of scanning, and sends these to the display signal generating unit 9. The graphics data read out of the display area are parallel data of 32 bits, and these parallel data are converted into serial data in the display signal generating unit 9.

The display signal generating unit 9 can be roughly divided into three major sections of a data converting section for converting 32-bit parallel graphics data read out of the display area of the image memory 5 into serial data, a cursor and blank generating section for generating cursor data indicative of a cursor and a blank signal for forming the blank area 37, and a video signal generating section for generating final graphics data on the basis of data transmitted by the data converting section and the cursor and blank generating section and converting these data into video signals before outputting these to the CRT 7.

The data converting section is composed of a preconverting circuit 21 for converting 32-bit parallel graphics data received by the image memory 5 into 4-bit parallel data, and a shift register 23 for converting 4-bit data from the preconverting circuit 21 into serial graphics data. Another shift register 25 the same as this shift register 23 in configuration is provided at the final stage of the cursor and blank generating section. This shift register 25 receives 4-bit parallel cursor data from a front-stage logic circuit 27 to display a cursor, and converts these into serial cursor data to output them. These shift registers 23 and 25 output each bit of the graphics data and the cursor data in synchronism with 48 MHz dot clock (DOTCLK) signal to determine each scanning timing of each dot in the display screen. The graphics data and the cursor data outputted from these shift registers 23 and 25 are inputted to an OR gate 29, and the ORed signals are outputted as final graphics data. The video signal generating circuit 31 converts the final graphics data into analog video signals.

The video signal generating circuit 31 also receives a blank signal ($\overline{\text{BRANK}}$) from the blank forming circuit 59. This blank signal is logically at "0" when the blank area 37 in the display screen is being scanned, but at "1" when the display area 36 is being scanned. The video signal generating circuit 31 outputs video signals indicative of the blank to the CRT 7 in response to the "0" blank signal, but outputs video signals converted from the final graphics data to the CRT 7 in response to the "1" blank signal. As a result, in the display screen of the CRT 7, a blank is displayed at the blank area 37, and an image (in which a cursor is overlapped with an image read from the display area in the image memory 5) is displayed in the display area 36.

The cursor and blank generating section will be explained in further detail hereinbelow.

The types of cursor generated by this embodiment will be explained briefly with reference to FIG. 2. There are two types of cursor. One is a cross-hair cursor composed of a horizontal cursor 33 and a vertical cursor 35 passing through the display screen in the horizontal and vertical directions, respectively, and the other is a cross-point cursor indicative of only a cross point of the horizontal and vertical cursors 33 and 35, as shown in FIG. 2. The cursor position is controlled by a mouse (not shown) connected to the host computer 1.

The cursor and blank generating section will be explained with reference to FIG. 1.

An ON/OFF and OR/AND register 39 is connected to the data bus 11 of the host computer 1. To this ON/OFF and OR/AND register 39, a 2-bit data is at first set from the host computer 1, and applied to a logic circuit 27 for generating cursor data. The first bit of the cursor data is an ON/OFF signal indicative of whether a cursor is displayed or not, and the second bit of the cursor data is an AND/OR signal indicative of the type of cursor.

Further, to the data bus 11 of the host computer 1, there are connected a start point register 43 and an end point register 45 provided within a horizontal cursor signal generating circuit 41, a vertical cursor start point register 47 and a vertical cursor end point register 49. To these registers 43, 45, 47 and 49, data indicative of start and end points of the horizontal and vertical cursors are written. The data indicative of start and end points are written at a predetermined period, whenever the mouse is being activated. That is, the host computer 1 always monitors cursor position information supplied from the mouse; calculates the start and end points of the horizontal and vertical cursors so that a central position of the cross point of the vertical and horizontal cursors matches a specific position corresponding to the monitored position information on the display screen; and writes these data in the above-mentioned registers 43, 45, 47 and 49. The start and end points of the horizontal cursor are represented by the numbers of scanning lines counted from the upper end of the display area 36 of the display screen, and the start and end points of the vertical cursor are represented by the numbers of dots counted from the left end of the display section. In calculation of the start and end points of the horizontal and vertical cursors, widths of the horizontal and vertical cursors are taken into account, because these data are previously given to the host computer 1. In more detail, if the width of the cursor is n dots, the end point data is a value obtained by adding $(n-1)$ dots to the start point data.

A register controller 51 is connected to the control bus 13 of the host computer 1. This register controller 51 receives various control information from the host computer 1, to write start and end point data in the registers 39, 43, 45, 47 and 49, and controls the writing operation of data to each of these registers.

The horizontal cursor signal generating circuit 41 compares start and end point data (scanning line numbers) of the horizontal cursor stored in the start point register 43 and the end point register 45, with a Y address (scanning line number) given by the display controller 3 and along which data are read from the image memory 5. When the Y address lies within a range from the start point to the end point, a horizontal cursor signal Y of logical level "1" is outputted to display a horizontal cursor. This horizontal cursor signal Y is inputted to a logic circuit 27.

The start and end point data of the vertical cursor set in the registers 47 and 49 are 11-bit data, and can represent any dots from the first dot to 1120-th dot in the display section. The 11-bit data indicative of start and end points are separated into 9 higher significant bits and 2 lower significant bits. The 9 higher significant bits are given to the start and end point comparators 53 and 55, and compared with 9-bit data given by the counter 57. The 9 higher significant bits of start and end point data represent block numbers to which the start and end points belong, respectively (referred to as a start point block and an end point block), obtained when the display section is divided into blocks each including 4 dots and the divided 4-dot blocks are numbered beginning from the leftmost end in order. On the other hand, the 2 lower significant bits of start and end point data represent bit numbers obtained when the dots in the start point and end point block are numbered from the leftmost end.

When the blank signal ($\overline{\text{BRANK}}$) from the blank generating circuit 59 is logically at "1" level; that is, when the horizontal scanning position is located in the display section on the display screen, the counter 57 is activated to count a 12-MHz load clock (LDCK) given through a count controller 61. In response to a horizontal scanning start timing signal from the display controller 3, the count controller 61 allows the load clock to pass only during each horizontal scanning period. Since the frequency of this load clock is 12 MHz, the period of the load clock is four times longer than that of the 48-MHz dot clock. Therefore, the value counted by the counter 57 indicates the block number of the block (referred to as scanned blocks) to which the horizontally scanned dot belongs when the display section is divided into blocks including 4 dots.

The start and end point comparators 53 and 55 compare the scanned block numbers from the counter 57 with the start and end point block numbers from the registers 47 and 49, and generate logical "0" level start and end timing signals, respectively. These start and end point timing signals are inputted to a width signal generating circuit 63. This width signal generating circuit 63 generates a logical "1" level width timing signal from when the start point timing signal is inputted to when the start point timing signal is inputted.

Two lower significant bits of the start point data, two lower significant bits of the end point data, the start point timing signal, the end point timing signal, and the width timing signal are all applied to plural address input terminals of a vertical cursor data memory 65. In more detail, the 2 lower significant bits of the start point data are applied to a first bit address terminal A0 and a second bit address terminal A1 of the vertical cursor data memory 65; the 2 lower significant bits of the end point data are applied to a third bit address terminal A2 and a fourth bit address terminal A3; the start timing signal is applied to a fifth bit address terminal A4; the end point timing signal is applied to a sixth bit address terminal A5; and the width timing signal is applied to a seventh bit address terminal A6 of the vertical cursor data memory 65, respectively.

Further, an eighth bit address terminal A7 is fixed at logical "0" level.

This vertical cursor data memory 65 is a PROM, for instance, in which 4-bit pattern groups each composed of four vertical cursor data A to D are previously programmed as shown in Table 1. Therefore, a pattern of specific vertical cursor data A to D corresponding to any given address pattern A0 to A7 can be read from the PROM, and then inputted to the logic circuit 27 in parallel.

TABLE 1A

| | ADDRESS | | | | | | | | CURSOR DATA | | | |
|---|---|---|---|---|---|---|---|---|---|---|---|---|
| | BIN | | | | | | | | | | | |
| HEX | A7 | A6 | A5 | A4 | A3 | A2 | A1 | A0 | D | C | B | A |
| 40h | 0 | 1 | 0 | 0, | 0 | 0 | 0 | 0 | 0 | 0 | 0 | 1 |
| 41h | 0 | 1 | 0 | 0, | 0 | 0 | 0 | 1 | 0 | 0 | 0 | 0 |
| 42h | 0 | 1 | 0 | 0, | 0 | 0 | 1 | 0 | 0 | 0 | 0 | 0 |
| 43h | 0 | 1 | 0 | 0, | 0 | 0 | 1 | 1 | 0 | 0 | 0 | 0 |
| 44h | 0 | 1 | 0 | 0, | 0 | 1 | 0 | 0 | 0 | 0 | 1 | 1 |
| 45h | 0 | 1 | 0 | 0, | 0 | 1 | 0 | 1 | 0 | 0 | 1 | 0 |
| 46h | 0 | 1 | 0 | 0, | 0 | 1 | 1 | 0 | 0 | 0 | 0 | 0 |
| 47h | 0 | 1 | 0 | 0, | 0 | 1 | 1 | 1 | 0 | 0 | 0 | 0 |
| 48h | 0 | 1 | 0 | 0, | 1 | 0 | 0 | 0 | 0 | 1 | 1 | 1 |
| 49h | 0 | 1 | 0 | 0, | 1 | 0 | 0 | 1 | 0 | 1 | 1 | 0 |
| 4Ah | 0 | 1 | 0 | 0, | 1 | 0 | 1 | 0 | 0 | 1 | 0 | 0 |
| 4Bh | 0 | 1 | 0 | 0, | 1 | 0 | 1 | 1 | 0 | 0 | 0 | 0 |
| 4Ch | 0 | 1 | 0 | 0, | 1 | 1 | 0 | 0 | 1 | 1 | 1 | 1 |
| 4Dh | 0 | 1 | 0 | 0, | 1 | 1 | 0 | 1 | 1 | 1 | 1 | 0 |
| 4Eh | 0 | 1 | 0 | 0, | 1 | 1 | 1 | 0 | 1 | 1 | 0 | 0 |
| 4Fh | 0 | 1 | 0 | 0, | 1 | 1 | 1 | 1 | 1 | 0 | 0 | 0 |

TABLE 1B

| | ADDRESS | | | | | | | | CURSOR DATA | | | |
|---|---|---|---|---|---|---|---|---|---|---|---|---|
| | BIN | | | | | | | | | | | |
| HEX | A7 | A6 | A5 | A4 | A3 | A2 | A1 | A0 | D | C | B | A |
| 50h | 0 | 1 | 0 | 1, | 0 | 0 | 0 | 0 | 0 | 0 | 0 | 1 |
| 51h | 0 | 1 | 0 | 1, | 0 | 0 | 0 | 1 | 0 | 0 | 0 | 1 |
| 52h | 0 | 1 | 0 | 1, | 0 | 0 | 1 | 0 | 0 | 0 | 0 | 1 |
| 53h | 0 | 1 | 0 | 1, | 0 | 0 | 1 | 1 | 0 | 0 | 0 | 1 |
| 54h | 0 | 1 | 0 | 1, | 0 | 0 | 0 | 0 | 0 | 0 | 1 | 1 |
| 55h | 0 | 1 | 0 | 1, | 0 | 1 | 0 | 1 | 0 | 0 | 1 | 1 |
| 56h | 0 | 1 | 0 | 1, | 0 | 1 | 1 | 0 | 0 | 0 | 1 | 1 |
| 57h | 0 | 1 | 0 | 1, | 0 | 1 | 1 | 1 | 0 | 0 | 1 | 1 |
| 58h | 0 | 1 | 0 | 1, | 1 | 0 | 0 | 0 | 0 | 1 | 1 | 1 |
| 59h | 0 | 1 | 0 | 1, | 1 | 0 | 0 | 1 | 0 | 1 | 1 | 1 |
| 5Ah | 0 | 1 | 0 | 1, | 1 | 0 | 1 | 0 | 0 | 1 | 1 | 1 |
| 5Bh | 0 | 1 | 0 | 1, | 1 | 0 | 1 | 1 | 0 | 1 | 1 | 1 |
| 5Ch | 0 | 1 | 0 | 1, | 1 | 1 | 0 | 0 | 1 | 1 | 1 | 1 |
| 5Dh | 0 | 1 | 0 | 1, | 1 | 1 | 0 | 1 | 1 | 1 | 1 | 1 |
| 5Eh | 0 | 1 | 0 | 1, | 1 | 1 | 1 | 0 | 1 | 1 | 1 | 1 |
| 5Fh | 0 | 1 | 0 | 1, | 1 | 1 | 1 | 1 | 1 | 1 | 1 | 1 |

TABLE 1C

| | ADDRESS | | | | | | | | CURSOR DATA | | | |
|---|---|---|---|---|---|---|---|---|---|---|---|---|
| | BIN | | | | | | | | | | | |
| HEX | A7 | A6 | A5 | A4 | A3 | A2 | A1 | A0 | D | C | B | A |
| 60h | 0 | 1 | 1 | 0, | 0 | 0 | 0 | 0 | 1 | 1 | 1 | 1 |
| 61h | 0 | 1 | 1 | 0, | 0 | 0 | 0 | 1 | 1 | 1 | 1 | 0 |
| 62h | 0 | 1 | 1 | 0, | 0 | 0 | 1 | 0 | 1 | 1 | 0 | 0 |
| 63h | 0 | 1 | 1 | 0, | 1 | 0 | 1 | 1 | 1 | 0 | 0 | 0 |
| 64h | 0 | 1 | 1 | 0, | 0 | 1 | 0 | 0 | 1 | 1 | 1 | 1 |
| 65h | 0 | 1 | 1 | 0, | 0 | 1 | 0 | 1 | 1 | 1 | 1 | 0 |
| 66h | 0 | 1 | 1 | 0, | 0 | 1 | 1 | 0 | 1 | 1 | 0 | 0 |
| 67h | 0 | 1 | 1 | 0, | 0 | 1 | 1 | 1 | 1 | 0 | 0 | 0 |
| 68h | 0 | 1 | 1 | 0, | 1 | 0 | 0 | 0 | 1 | 1 | 1 | 1 |
| 69h | 0 | 1 | 1 | 0, | 1 | 0 | 0 | 1 | 1 | 1 | 1 | 0 |
| 6Ah | 0 | 1 | 1 | 0, | 1 | 0 | 1 | 0 | 1 | 1 | 0 | 0 |
| 6Bh | 0 | 1 | 1 | 0, | 1 | 0 | 1 | 1 | 1 | 0 | 0 | 0 |
| 6Ch | 0 | 1 | 1 | 0, | 1 | 1 | 0 | 0 | 1 | 1 | 1 | 1 |
| 6Dh | 0 | 1 | 1 | 0, | 1 | 1 | 0 | 1 | 1 | 1 | 1 | 0 |
| 6Eh | 0 | 1 | 1 | 0, | 1 | 1 | 1 | 0 | 1 | 1 | 0 | 0 |

TABLE 1C-continued

| ADDRESS | | | | | | | | | | | |
|---|---|---|---|---|---|---|---|---|---|---|---|
| | BIN | | | | | | | | CURSOR DATA | | | |
| HEX | A7 | A6 | A5 | A4 | A3 | A2 | A1 | A0 | D | C | B | A |
| 6Fh | 0 | 1 | 1 | 0, | 1 | 1 | 1 | 1 | 1 | 0 | 0 | 0 |

TABLE 1D

| ADDRESS | | | | | | | | | | | | |
|---|---|---|---|---|---|---|---|---|---|---|---|---|
| | BIN | | | | | | | | CURSOR DATA | | | |
| HEX | A7 | A6 | A5 | A4 | A3 | A2 | A1 | A0 | D | C | B | A |
| 70h | 0 | 1 | 1 | 1, | 0 | 0 | 0 | 0 | 1 | 1 | 1 | 1 |
| 71h | 0 | 1 | 1 | 1, | 0 | 0 | 0 | 1 | 1 | 1 | 1 | 1 |
| 72h | 0 | 1 | 1 | 1, | 0 | 0 | 1 | 0 | 1 | 1 | 1 | 1 |
| 73h | 0 | 1 | 1 | 1, | 0 | 0 | 1 | 1 | 1 | 1 | 1 | 1 |
| 74h | 0 | 1 | 1 | 1, | 0 | 1 | 0 | 0 | 1 | 1 | 1 | 1 |
| 75h | 0 | 1 | 1 | 1, | 0 | 1 | 0 | 1 | 1 | 1 | 1 | 1 |
| 76h | 0 | 1 | 1 | 1, | 0 | 1 | 1 | 0 | 1 | 1 | 1 | 1 |
| 77h | 0 | 1 | 1 | 1, | 0 | 1 | 1 | 1 | 1 | 1 | 1 | 1 |
| 78h | 0 | 1 | 1 | 1, | 1 | 0 | 0 | 0 | 1 | 1 | 1 | 1 |
| 79h | 0 | 1 | 1 | 1, | 1 | 0 | 0 | 1 | 1 | 1 | 1 | 1 |
| 7Ah | 0 | 1 | 1 | 1, | 1 | 0 | 1 | 0 | 1 | 1 | 1 | 1 |
| 7Bh | 0 | 1 | 1 | 1, | 1 | 0 | 1 | 1 | 1 | 1 | 1 | 1 |
| 7Ch | 0 | 1 | 1 | 1, | 1 | 1 | 0 | 0 | 1 | 1 | 1 | 1 |
| 7Dh | 0 | 1 | 1 | 1, | 1 | 1 | 0 | 1 | 1 | 1 | 1 | 1 |
| 7Eh | 0 | 1 | 1 | 1, | 1 | 1 | 1 | 0 | 1 | 1 | 1 | 1 |
| 7Fh | 0 | 1 | 1 | 1, | 1 | 1 | 1 | 1 | 1 | 1 | 1 | 1 |

Figure 3:
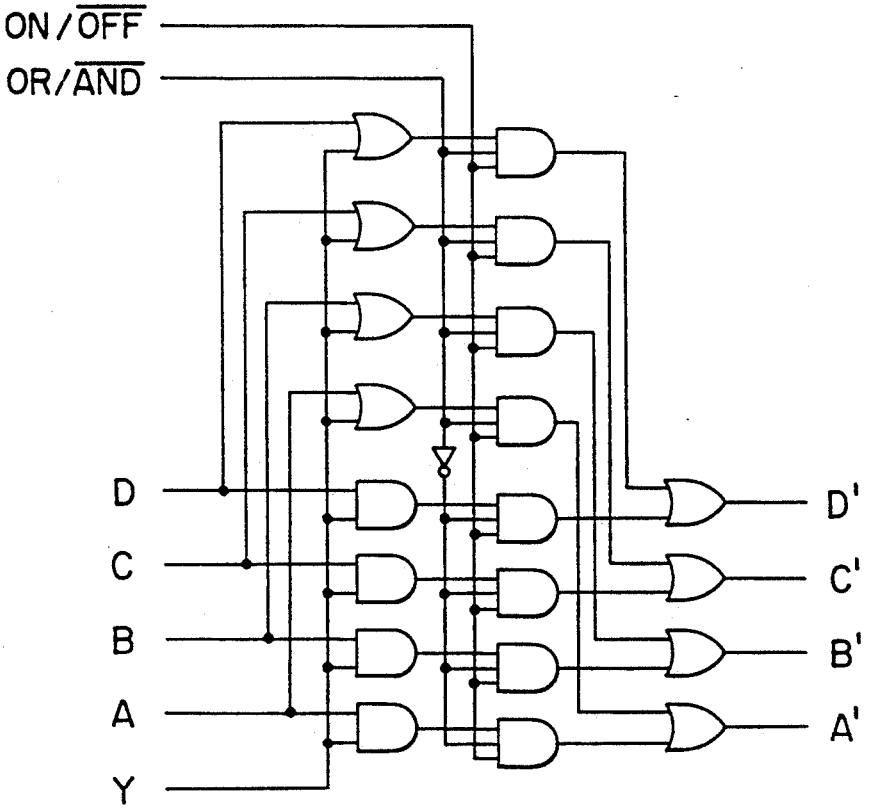
FIG. 3 is a logic circuit diagram showing the apparatus shown in FIG. 1.

The logic circuit 27 executes logical operation on the basis of the horizontal cursor signal Y and the vertical cursor data A to D and in response to the ON/OFF signal and the OR/AND signal, to generate 4-bit cursor data A' to D', as shown in FIG. 3 by way of example. As understood by the drawing, when the ON/OFF signal is at "0", the horizontal cursor signal Y and the vertical cursor data A to D are disregarded, so that cursor data A' to D' of "0000" can be generated; that is, no cursor is displayed. In other words, a cursor is displayed only when the ON/OFF signal is at "1". In this case, if the OR/AND signal is at "1", the cursor data A' to D' are logical sum signals of the vertical cursor data A to D and the horizontal cursor signal Y. If the OR-/AND signal is at "0", the cursor data A' to D' are logical product signals of the both. As a result, in the case of the logical sum signals, a cross-hair cursor is displayed. In the case of the logical product signals, a cross-point cursor is displayed.

The above-mentioned 4-bit pattern of cursor data A' to D' finally determined by the logic circuit 27 represents a white-black pattern of a specific 4-dot block in the display screen corresponding to these cursor data. Therefore, the decision of a pattern of the cursor data A' to D' is to previously determine a white-black pattern of the 4-dot block corresponding to the cursor data A' to D'. This pattern of the horizontal cursor is easily determined, because the horizontal cursor can be obtained by continuously generating a data pattern of "1111" during a horizontal scanning period between the start and end points of the horizontal cursor. In this embodiment, the patterns for the horizontal cursor can be determined by the horizontal cursor signal generating circuit 41, as already explained. On the other hand, the patterns for the vertical cursor cannot be determined simply as in the horizontal cursor. This is because there exist various variations in patterns from "0000" to "1111" according to mutual positional relationship between the start and end points of the vertical cursor and the 4-dot blocks whose white and black pattern must be determined. In the prior-art method, since these patterns have been determined by operation of the host computer, there exists a problem in that it takes much time and therefore it is difficult to smoothly move the cursor at high speed. In contrast with this, in the present invention, the above-mentioned has been solved by adoption of the vertical cursor data memory 65.

The operation of the vertical cursor data memory 65 will be described hereinbelow in further detail with reference to FIGS. 4 to 7.

Figure 4:
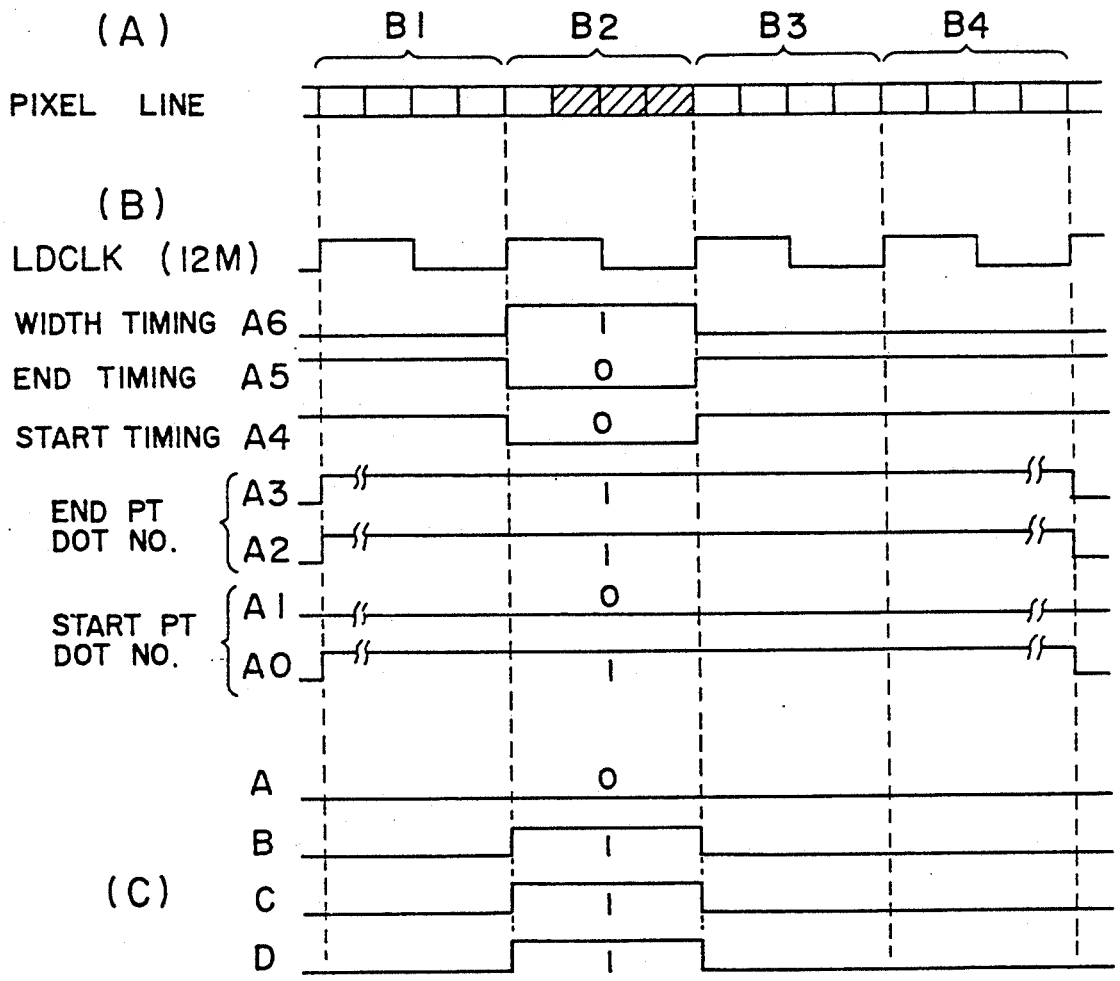
FIGS. 4 to 8 are timing charts for assistance in explaining the function of the vertical cursor data memory of the apparatus shown in FIG. 1.

FIG. 4 is a timing chart for assistance in explaining the operation of the vertical cursor data memory 65 executed when a 3-dot-width vertical cursor is displayed. FIG. 4(A) shows a pixel line forming a horizontal scanning line within the display screen. In this example, the display position of the vertical cursor is at three rightward pixels in a specific 4-dot block B2 of the pixel line. In this case, address data A0 to A6 as shown by FIG. 4(B) are applied to the vertical cursor data memory 65. That is, since the start point is at the second dot in the block B2, A0 and A1 are "1" and "0", respectively. Further, since the end point is at the fourth dot in the block B2, A2 and A3 are "1" and "1", respectively. Further, the start point, the end point and the width timing signal A4 to A6 are at "0", "0" and "1", respectively during the cycle at which LDCLK (12 MHz) corresponds to the block B2. The pattern of this address data A0 to A6 is listed in Table 1 as 4Dh in the form of sexadecimal number. Therefore, it is possible to read vertical cursor data A to D of the pattern, as shown in FIG. 4(C). These read vertical cursor data A to D are to display the dot pattern shown in FIG. 4(A) on the display screen.

Figure 5:
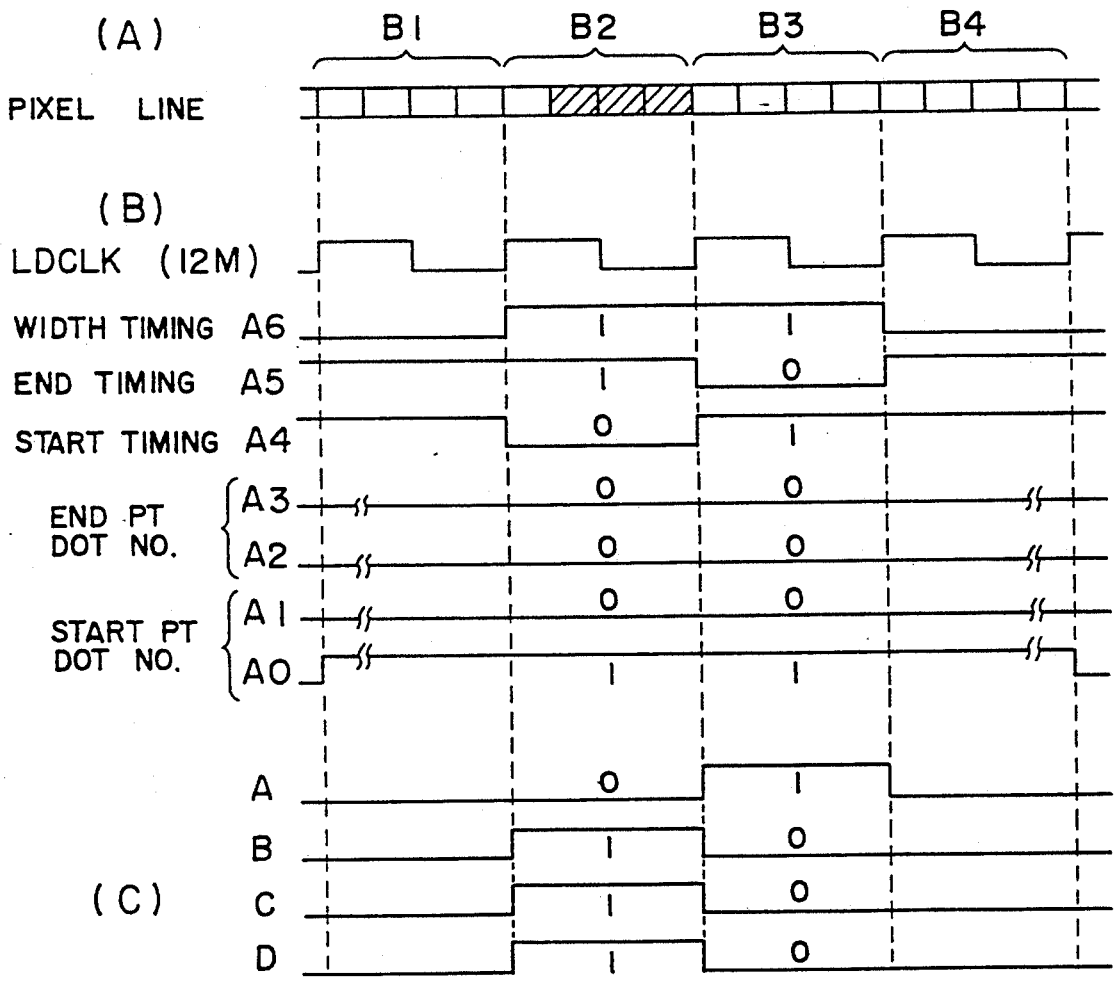

FIG. 5 is a timing chart obtained when the cursor width is added by one dot in the rightward direction from the state shown in FIG. 4. In this case, the address data A0 to A6 change from the pattern shown in FIG. 4 as follows: since the end point is shifted to the first block in the block B3, A2 and A3 change to "0" and "0", respectively. Further, since the cycle at which the end point timing signal A5 is at "0" is shifted to the cycle of the block B3 and additionally the width timing signal A6 is at "1" during the cycles B2 and B3 of the block, the pattern of the address data A0 to A6 is 61h in Table 1 at the cycle of the block B2 and 51h at the cycle of the block B3. As a result, the vertical cursor data A to D of the pattern as shown in FIG. 5(C) are read at each cycle to display the dot pattern shown in FIG. 5(A).

Figure 6:
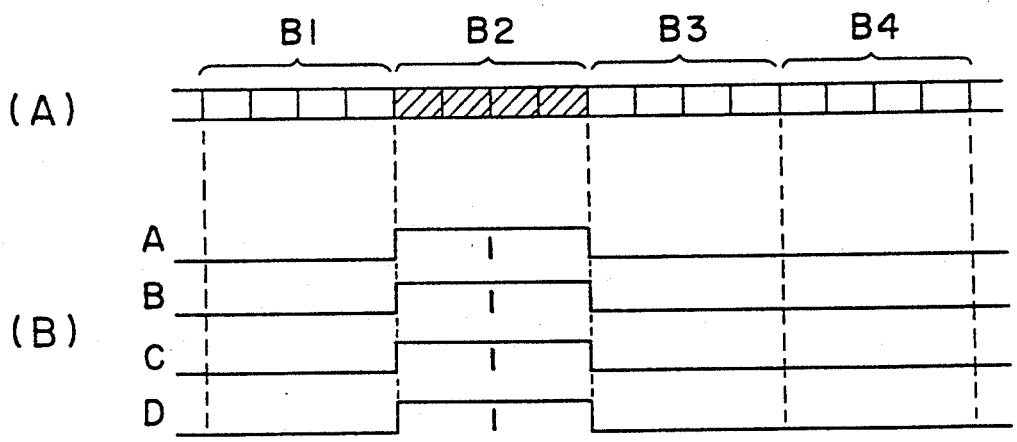

FIG. 6 shows only the read result obtained when the cursor width is added by one dot in the leftward direction from the state shown in FIG. 4. It is easily understood that the pattern of the read cursor data A to D as shown in FIG. 6(B) can display the dot pattern shown in FIG. 6(A).

Figure 7:
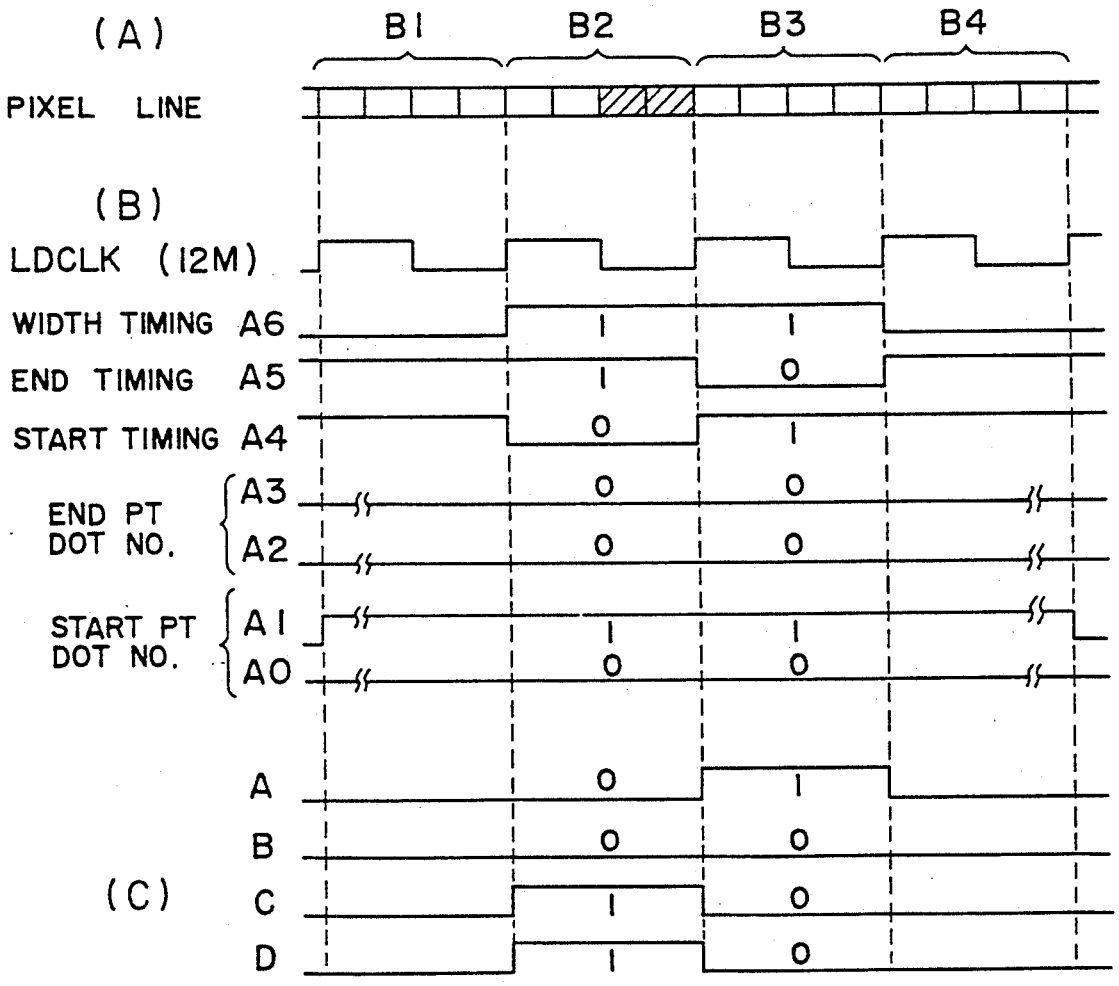

FIG. 7 shows a timing chart obtained when the cursor is shifted by one dot in the rightward direction from the state shown in FIG. 4. In this case, the pattern of the address data A0 to A6 is 62h at the cycle of block B2 and 52h at the cycle of block B3 in Table 1. As a result, vertical cursor data A to D of the pattern as shown in FIG. 7(C) are read at each cycle to display the dot pattern as shown in FIG. 7(A).

Figure 8:
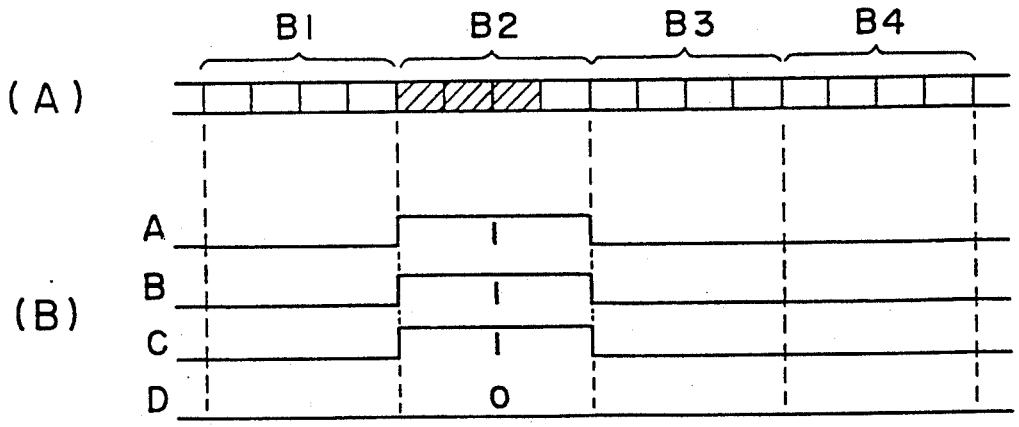

FIG. 8 shows the read result obtained when the cursor is shifted by one dot in the leftward direction from the state shown in FIG. 4. FIG. 8 clearly indicates that the pattern of the cursor data A to D is changed to shift the cursor.

Some cases have been described by way of examples. Without being limited thereto, however, it is possible to automatically read a pattern of vertical cursor data A to D from the vertical cursor data memory 65, so as to correspond to any cases where the vertical cursor changes in width and in display position. In these cases, the host computer 1 determines only the start and end points of the horizontal and vertical cursors on the basis of the position information detected by only the mouse, thus allowing the pattern of cursor data to be determined at high speed.

Further, since the cursor data are formed as 4-bit parallel data and converted into serial data at the final stage, it is possible to execute the cursor data forming processing in synchronism with the low-speed load clock (LDCLK) of 12 MHz as compared with the high speed dot clock (DOTCLK) of 49 MHz for determining the final timing, thus enabling the cursor to be generated at high speed.

One preferred embodiment has been explained by way of example. However, the present invention is not limited to only this embodiment. For instance, it is possible to form the parallel cursor data more or less than 4 bits. Further, the above embodiment has been explained on the assumption that the display is monochromatic display. The present invention can be of course applied to a color display. Further, the persons skilled in the art may modify the embodiment without departing from the spirit of the invention. However, the present invention includes these modifications.

As described above, in the cursor generating apparatus according to the present invention, since only the start and end points of the cursor are determined by the host computer; since the cursor data are not written in the image memory; and since the cursor data can be processed in the form of parallel data is synchronism with relatively slow clock, it is possible to generate cursor data at high speed, thus enabling the cursor to be shifted smoothly at high speed.

What is claimed is:

1. A cursor generating apparatus for generating cursor data applied in series to a display unit to display a cursor on a display screen in computer graphics, comprising:

register means for receiving and holding information indicative of start and end points of a cursor on the display screen and given from a host computer;

counting means for counting block numbers now being scanned on the basis of scanning timing related signals, when a scanning line is divided into plural blocks each including a predetermined number of pixels on the display screen;

comparing means for comparing the block number outputted from said counting means with a specific block number belonging to start and end points included in the information held in said register means and generating start and end point timing signals corresponding to the compared result;

generating means for generating a width timing signal on the basis of the start and end point timing signals;

cursor data memory means for receiving start and end point pixel numbers in a specific block included in the information indicative of the start and end points and held in said register means, the start and end point timing signals, and the width timing signal as address data and for reading one pattern in parallel from a pattern group of previously programmed cursor data of a predetermined number of bits; and shift register means for converting the pattern of cursor data read in parallel from said cursor data memory means into serial data.

* * * * *